US008357285B2

(12) United States Patent
Morii et al.

(10) Patent No.: US 8,357,285 B2
(45) Date of Patent: Jan. 22, 2013

(54) ACIDIC GOLD ALLOY PLATING SOLUTION

(75) Inventors: Yutaka Morii, Saitama (JP); Masanori Orihashi, Ageo (JP)

(73) Assignee: Rohm and Haas Electronic Materials LLC, Marlborough, MA (US)

( * ) Notice: Subject to any disclaimer, the term of this patent is extended or adjusted under 35 U.S.C. 154(b) by 682 days.

(21) Appl. No.: 12/156,839

(22) Filed: Jun. 5, 2008

(65) Prior Publication Data

US 2009/0014335 A1 Jan. 15, 2009

(30) Foreign Application Priority Data

Jun. 6, 2007 (JP) ..... 2007-151013

(51) Int. Cl.

| | |
|---|---|
| ***C23C 18/40*** | (2006.01) |
| ***C23C 28/00*** | (2006.01) |
| ***C25D 3/62*** | (2006.01) |
| ***C25D 3/56*** | (2006.01) |
| ***C25D 5/10*** | (2006.01) |
| ***C25D 5/12*** | (2006.01) |

(52) U.S. Cl. ..... 205/247; 205/259; 205/176; 205/181; 205/183; 106/1.26

(58) Field of Classification Search ..... 205/247, 205/259, 176, 181, 183; 427/437, 443.1; 106/1.26

See application file for complete search history.

(56) References Cited

U.S. PATENT DOCUMENTS

| | | | | |
|---|---|---|---|---|
| 3,642,589 | A | 2/1972 | Nobel et al. | 204/44 |
| 3,787,463 | A | 1/1974 | Zuntini et al. | 260/430 |
| 4,391,679 | A | 7/1983 | Zilske et al. | 204/43 G |
| 4,591,415 | A * | 5/1986 | Whitlaw | 205/125 |
| 2002/0063063 | A1 | 5/2002 | Uchida et al. | 205/247 |

FOREIGN PATENT DOCUMENTS

| | | |
|---|---|---|
| EP | 0 037 535 | 10/1981 |
| EP | 0 150 439 | 8/1985 |
| RU | 1788096 A1 * | 1/1993 |

OTHER PUBLICATIONS

Giurgiu et al., "Metal Gold Plating Processes", Industria Usoara (no month, 1971), vol. 18, No. 7, pp. 432-439. Abstract Only (1 page).*

Giurgiu et al., "Metal Gold Plating Processes", Industria Usoara (no month, 1971), vol. 18, No. 7, pp. 432-439. Full Document.*

European Search Report of corresponding European Application No. EP 08 15 7779.

Giurgiu et al.; "Procedures for Gold Plating of Metals"; Light Industry, 18, No. 7, 1971.

* cited by examiner

*Primary Examiner* — Edna Wong
(74) *Attorney, Agent, or Firm* — John J. Piskorski

(57) ABSTRACT

A gold alloy plating solution and plating method thereof that provides a gold plating solution with high deposition selectivity by using a gold plating solution that contains gold cyanide, cobalt ions, hexamethylene tetramine, and specific glossing agents.

11 Claims, No Drawings

ACIDIC GOLD ALLOY PLATING SOLUTION

The present invention relates to an acidic gold alloy plating solution.

In recent years, gold plating has been widely used in electronic devices and electronic components in order to protect the electronic components such as the surface of contact terminals, because of the excellent electrical characteristics and corrosion-resistant properties of gold. Gold plating is used as a surface treatment for the electrode terminals of semiconductor elements, as leads formed in plastic film, or as a surface treatment for electronic components such as connectors which connect to electronic devices. Materials which can be gold plated include metal, plastic, ceramic, and semiconductor, and the like.

The connectors that connect electronic devices use a hard gold plating because the gold plating film used as a surface treatment must have corrosion resistance, wear resistance, and electrical conductivity, depending on the characteristics of use. Gold cobalt alloy plating and gold nickel alloy plating, and the like, have long been known as hard gold platings (for example, see DE 1111897 and JP 60-155696). Generally, copper or a copper alloy is used as the substrate for the electronic components such as a connector. However, when gold is deposited on the surface of copper, the copper will diffuse into the gold film. Therefore, when gold plating is performed as the surface treatment for copper, nickel plating is normally performed on the copper surface as a barrier layer for the copper substrate. Generally, gold plating is then performed on the surface of the nickel plating layer.

Standard methods for performing localized hard gold plating on electronic components such as connectors include spot plating, plating by controlling the liquid surface, rack plating and barrel plating, and the like.

However, with a conventional gold plating solution, there are problems during electrolytic plating with a high current density because so-called burn will occur on the gold film that is deposited. Furthermore, with a conventional gold plating solution, there is a problem that when localized plating is performed on a region of an electronic component where a gold plating film is required, gold or gold alloys will also be deposited on the area around this region, or in other words, on regions which do not require a gold plating film.

Various technologies have been proposed for preventing this deposition of gold in unwanted areas. The present inventors have discovered that unnecessary gold deposition can be controlled by using an acidic gold cobalt plating bath with hexamethylene tetramine as an additive, and have already applied for a patent (see JP 2006-224465). Using these technologies, unnecessary gold deposition can be controlled, but there is demand to further improve the gloss of the gold plating film that is deposited, as well as to improve the deposition speed and to improve the current density range where favorable plating is possible.

An object of the present invention is to provide an acidic gold alloy plating solution and a gold alloy plating method that maintains the properties as a gold plating film on the surface of a connector, deposits a relatively thick gold plating film at a high current density, deposits a gold plating film in the desired regions while suppressing deposition in unwanted region, which improves the deposition speed of the gold plating film, and enables plating across a broad range of current density.

In order to resolve the aforementioned problems and as a result of diligent research into gold plating solutions, the present inventors have discovered that a gold alloy plating film with the corrosion resistance, wear resistance, and electrical conductivity required of electrical components such as connectors can be formed while suppressing the deposition of the gold alloy plating film in unnecessary areas, improving the operating conditions for the plating invention, and improving the deposition film speed of the gold alloy plating film by maintaining a gold cobalt alloy plating solution in a weakly acidic condition and adding hexamethylenetetramine and specific glossing agents, and have thus achieved the present invention.

One aspect of the present invention provides an acidic gold alloy plating solution containing gold cyanide or salt thereof, cobalt ions, chelating agent, hexamethylene tetramine, a glossing agent, and if necessary, a pH adjusting agent, wherein the glossing agent of said plating solution is a nitrogen atom containing compound with a carboxyl group or a hydroxyl group, or a sulfur atom containing compound with a carboxyl group.

Furthermore, the present invention provides a gold alloy plating method by electrolytic plating using an acidic gold alloy plating solution containing gold cyanide or salt thereof, cobalt ions, chelating agent, hexamethylene tetramine, a nitrogen atom containing compound with a carboxyl group or a hydroxyl group or a sulfur atom containing compound with a carboxyl group, and if necessary, a pH adjusting agent.

Furthermore, the present invention provides a method for manufacturing a connector with a gold alloy plating film, by performing nickel plating on the contact regions of the connector, and then performing gold alloy plating on the nickel film, wherein said gold alloy plating is electrolytic plating using an acidic gold alloy plating solution containing gold cyanide or salt thereof, cobalt ions, chelating agent, hexamethylene tetramine, and a nitrogen atom containing compound with a carboxyl group or a hydroxyl group, or a sulfur atom containing compound with a carboxyl group.

The acidic gold alloy plating solution of the present invention can use a wide range of current density, and in particular, can provide a gold alloy plating film with good gloss even at a high current density. Furthermore, the acidic gold alloy plating solution of the present invention can cause a relatively safe gold alloy plating film at a high current density. Using the acidic gold alloy plating solution of the present invention, these depositions increase, and a gold alloy plating film with favorable gloss can be formed across a wide range of plating operations.

When forming a gold alloy plating film with the corrosion resistance, wear resistance, and electrical conductivity required of electrical components such as connectors using the acidic gold alloy plating solution of the present invention, the gold allow plating film can be deposited in the desired locations while suppressing deposition in unwanted regions. In other words, the gold alloy plating solution or method of the present invention has excellent deposition selectivity. Suppressing deposition of the plating film in regions where the plating film is not necessary can suppress the unnecessary consumption of metal, which is advantageous from a economical perspective.

The acidic gold alloy plating solution of the present invention contains gold cyanide or salt thereof, cobalt ions, chelating agent, hexamethylene tetramine, a glossing agent, and if necessary, can also contain a pH adjusting agent. The acidic gold alloy plating solution of the present invention is kept acidic, and preferably the pH is maintained between 3 and 6.

Examples of gold ion sources which are an essential component of the present invention include gold cyanide salts such as gold cyanide, gold (I) potassium cyanide, gold (II) potassium cyanide, and gold ammonium cyanide, and the like. The gold cyanide or salt thereof can be used independently or as a combination of two or more. In addition, other commonly known gold ion sources may be used in combination. Examples of commonly known gold ion sources include gold (I) potassium chloride, gold (I) sodium chloride, gold (II) potassium chloride, gold (II) sodium chloride, gold potassium thiosulfate, gold sodium thiosulfate, gold potassium thiosulfite, and gold sodium thiosulfite, and the like, and combinations of two or more thereof may be used. Gold cyanide salts, and particularly gold (I) potassium cyanide are preferable for use in the plating solution of the present invention.

The amount of these gold ion sources added to the plating solution is generally in a range between 1 g/L and 20 g/L, preferably in a range between 3 g/L and 16 g/L, calculated as gold.

The cobalt ion source that is used with the present invention can be any cobalt compound that is soluble in the plating solution of the present invention, and examples include cobalt sulfate, cobalt chloride, cobalt carbonate, cobalt sulfamate, and cobalt gluconate, as well as combinations of two or more thereof. Inorganic cobalt salts, and especially basic cobalt carbonate are preferable for use in the plating solution of the present invention.

The amount of these cobalt ions added to the plating solution is generally in a range between 0.05 g/L and 3 g/L, preferably in a range between 0.1 g/L and 1 g/L, calculated as cobalt.

The chelating agent that can be used with the present invention can be a commonly known compound that is generally used as a chelating agent in gold plating solutions. Examples include compounds containing a carboxyl group such as carboxylic acids and salts thereof like citric acid, potassium citrate, sodium citrate, tartaric acid, oxalic acid, succinic acid, adipic acid, malic acid, lactic acid, and benzoic acid, and the like, and compounds containing a phosphonate group which have a phosphonate group or salt thereof in the molecule, and the like. Examples of compounds containing a phosphonate group include compounds which have a plurality of phosphonate groups in a molecule such as aminotrimethylene phosphonic acid, 1-hydroxyethylidene-1,1-diphosphonic acid, ethylenediamine tetramethylene phosphonic acid, diethylenetriamine pentamethylene phosphonic acid, as well as alkali metal salts or ammonium salts thereof. Furthermore, a nitrogen compound such as ammonia or ethylene diamine can be used as auxiliary chelating agent together with the compound containing a carboxyl group. The chelating agent can also be a combination of two or more compounds. With the present invention, there are nitrogen atom containing compounds which have a carboxyl group or a hydroxyl group or sulfur atom containing compounds which have a carboxyl group that are used as the glossing agent, which will be described later, which are also compounds that have a complexing capability. However, the chelating agent of this specification does not include nitrogen atom containing compounds which have a carboxyl group or a hydroxyl group or sulfur containing compounds which have a carboxyl group.

The amount of these chelating agents added to the plating solution is generally in a range between 0.1 g/L and 300 g/L, preferably in a range between 1 g/L and 200 g/L.

The hexamethylene tetramine used with the present invention is generally added to the plating solution in a range between 0.05 g/L and 10 g/L, preferably in a range between 0.1 g/L and 5 g/L.

The glossing agent which can be used with the present invention is a nitrogen atom containing compound which has a carboxyl group or a hydroxyl group, or a sulfur containing compound which has a carboxyl group. Examples of nitrogen atom containing compounds which have a carboxyl group include amino acids, such as neutral amino acids, acidic amino acids, or basic amino acids; pyridine compounds containing a carboxyl group such as pyridine carboxylic acids (such as 2-pyridine carboxylic acid, 3-pyridine carboxylic acid, and 4-pyridine carboxylic acid) as well as salts thereof; and also iminodiacetic acid; nitrillotriacetic acid; diethylenetriamine pentaacetic acid; and ethylenediamine tetraacetic acid. Examples of neutral amino acids include alanine, glycine, branched amino acids such as valine and leucine, sulfur containing amino acids such as cystine, amide amino acids such as asparagine or glutamine, aliphatic amino acids such as hydroxyamino acids like serine; aromatic amino acids such as phenylalanine, tyrosine, and tryptophan, as well as imino acids. Examples of basic amino acids include lysine and arginine, and the like. Examples of acidic amino acids include asparaginic acid and glutamic acid, and the like. Examples of nitrogen containing compounds with a hydroxyl group include alkanolamines such as methanolamine, ethanolamine, propanolamine, and isopropanolamine, dialkanolamines such as dimethanolamine, diethanolamine, dipropanolamine, diisopropanolamine, and dibutanolamine, trialkanolamines such as trimethanolamine, and triethanolamine, and aminodiol compounds such as aminomethanediol, aminoethanediol, and the like. Examples of sulfur atom containing compounds with a carboxyl group include thiolactic acid, thiodiacetic acid, and thiomalic acid, and the like. The glossing agent can be used independently or as a combination of two or more.

The amount of glossing agent added to the plating solution is generally in a range between 0.01 g/L and 50 g/L, preferably in a range between 0.1 g/L and 10 g/L.

The pH of the acidic gold alloy plating solution of the present invention is adjusted to be in the acidic region. Preferably the pH is in a range between 3 and 6. More preferably the pH is adjusted to a range between 3.5 and 5. The pH of the plating solution can be adjusted by adding an alkali metal hydroxide such as potassium hydroxide or with an acidic substance such as citric acid or phosphoric acid, or the like. In particular, a compound which has a pH buffer effect is preferably added to the gold alloy plating solution of the present invention. Citric acid, tartaric acid, oxalic acid, succinic acid, phosphoric acid, and sulfurous acid and salts thereof can be used as compounds which have a pH buffer effect. By adding these compounds which have a pH buffer effect, the pH of the plating solution can be maintained at a steady level, and the plating operation can be performed for a long period of time.

The gold alloy plating solution of the present invention can use or be prepared with the aforementioned components in accordance with commonly known methods. For example, the plating solution of the present invention can be obtained by simultaneously or separately adding the aforementioned quantities of gold cyanide or salt thereof, cobalt ion source, chelating agent, hexamethylenetetramine, and glossing agent to water, mixing and then adjusting the pH by adding a pH adjusting agent, and if necessary, a pH buffering agent.

Furthermore, conductivity improving agents, antifungal agents, and surfactants, or the like, can also be added to the gold alloy plating solution of the present invention to the degree that there is no deviation from the objective and effect of the present invention.

When performing the gold alloy plating of the present invention, the temperature of the plating solution should be in a range between 20° C. and 80° C., preferably in a range between 30° C. and 60° C. The current density can be in a range between 0.1 and 80 A/dm$^2$. In particular, the plating solution of the present invention preferably uses a current density in a range between 10 and 70 A/dm$^2$, more preferably in a range between 30 and 50 A/dm$^2$. The positive electrode is preferably an insoluble positive electrode. Preferably the gold alloy plating solution is mixed while performing the electrolytic gold alloy plating.

The method of manufacturing a connector using the gold alloy plating solution of the present invention can be a commonly known method. Standard methods for performing localized hard gold alloy plating on electronic components such as connectors include spot plating, plating by controlling the liquid surface, rack plating and barrel plating, and the like.

When a gold alloy plating process is performed for the final surface of the connector, an intermediate metal layer such as a nickel film made by nickel plating is preferably formed on the surface of the connector component. A gold alloy plating film can be formed on a conductive layer such as a nickel film using the gold alloy plating solution of the present invention and a spot electrolytic plating method.

EXAMPLES 1-8

A gold cobalt plating solution consisting of the following substances was prepared as the base bath.

| | |
|---|---|
| Gold (I) potassium cyanide | 15 g/L (10 g/L as gold) |
| Basic cobalt carbonate | 1.16 g/L (0.5 g/L as cobalt) |
| Tri potassium citrate monohydrate | 116 g/L |
| Citric anhydride | 66.11 g/L |
| hexamethylenetetramine | 0.5 g/L |
| water (deionized water) | remainder |

The pH of the above plating solution was adjusted to 4.3 using potassium hydroxide.

Example 1

The gold cobalt plating bath of Example 1 was prepared by adding 0.5 g/L of nicotinic acid (3-pyridinecarboxylic acid) as a glossing agent prior to adjusting the pH of the aforementioned base bath, and then adjusting the pH to 4.3.

Examples 2 Through 8

Gold cobalt plating solutions were prepared similar to Example 1, except that the compounds shown in Table 1 below were added at the concentrations shown in place of the nicotinic acid.

Comparative Example 1

As an example of a conventional hard plating solution, the same gold cobalt plating solution as the base bath was prepared with the exception that the hexamethylene tetramine of the aforementioned base bath was not added.

Comparative Examples 2 THROUGH 4

Gold cobalt plating solutions were prepared similar to Example 1, except that imidazole was added in the amounts shown in Table 1 in place of the nicotinic acid.

Comparative Examples 5 THROUGH 7

Gold cobalt plating solutions were prepared by adding the compound shown in Table 1 at the concentrations shown to the gold cobalt plating solution of Comparative Example 1, and then the pH was adjusted to 4.3.

Examples 9 Through 11

Embodiments were prepared by further adding either 1, 3 or 5 g/L of glycine to the gold cobalt plating solution of Example 1, and then adjusting the pH to 4.3.

Hull Cell Test

A hull cell test was performed on the base bath, Examples 1 through 11, and Comparative Examples 1 through 7.

The hull cell test was performed using platinum clad titanium as an insoluble positive electrode and a nickel plated copper hull cell panel (nickel plating thickness 0.1 μm) as the negative electrode, by applying a current of 2 amperes (2 A) between the positive electrode and the negative electrode for 1 minute at a bath temperature of 60° C. while agitating with a cathode rocker at a rate of 4 m/min.

Observation results of the appearance on the hull cell panel are shown in Table 1. The plating film was measured using a fluorescent x-ray microfilm thickness meter (SFT-9400 manufactured by SII) in a total of nine locations (numbered between 1 and 9 in order from the left) from a location 1 cm from the left edge (high current density side) to the right (low current density side) at 1 cm intervals at a position 1 cm from the bottom of the hull cell panel. The units are shown in micrometers (μm).

TABLE 1

| | Added Compound (Concentration) | | Appearance | |
|---|---|---|---|---|
| | Hexamethylene tetramine | Other added compounds | Area of plating burn | Area of gloss |
| Base bath | hexamethylene tetramine (0.5 g/L) | — | 4 cm | 6 cm |
| Example 1 | hexamethylene tetramine (0.5 g/L) | nicotinic acid (0.5 g/L) | 2.5 cm | 7.5 cm |
| Example 2 | hexamethylene tetramine (0.5 g/L) | nicotinic acid (1 g/L) | 2.5 cm | 7.5 cm |
| Example 3 | hexamethylene tetramine (0.5 g/L) | nicotinic acid (3 g/L) | 1.5 cm | 8.5 cm |
| Example 4 | hexamethylene tetramine (0.5 g/L) | diethanolamine (1 g/L) | 3.5 cm | 6.5 cm |
| Example 5 | hexamethylene tetramine (0.5 g/L) | diethanolamine (3 g/L) | 2 cm | 8 cm |
| Example 6 | hexamethylene tetramine (0.5 g/L) | glycine (3 g/L) | 3 cm | 7 cm |
| Example 7 | hexamethylene tetramine (0.5 g/L) | thiolactic acid (10 g/L) | 2 cm | 8 cm |
| Example 8 | hexamethylene tetramine (0.5 g/L) | diethanolamine (3 g/L) + dihydrogenammonium phosphate (4.5 g/L) | 1.5 cm | 8.5 cm |
| Example 9 | hexamethylene tetramine (0.5 g/L) | nicotinic acid (0.5 g/L) + glycine (1 g/L) | 1.5 cm | 8.5 cm |
| Example 10 | hexamethylene tetramine (0.5 g/L) | nicotinic acid (0.5 g/L) + glycine (3 g/L) | 1.5 cm | 8.5 cm |
| Example 11 | hexamethylene tetramine (0.5 g/L) | nicotinic acid (0.5 g/L) + glycine (5 g/L) | 0.5 cm | 9.5 cm |

TABLE 1-continued

| | Added Compound (Concentration) | | Appearance | |
|---|---|---|---|---|
| | Hexamethylene tetramine | Other added compounds | Area of plating burn | Area of gloss |
| Comparative Example 1 | — | — | 5 cm | 5 cm |
| Comparative Example 2 | hexamethylene tetramine (0.5 g/L) | imidazole (0.5 g/L) | 4 cm | 6 cm |
| Comparative Example 3 | hexamethylene tetramine (0.5 g/L) | imidazole (1 g/L) | 4 cm | 6 cm |
| Comparative Example 4 | hexamethylene tetramine (0.5 g/L) | imidazole (5 g/L) | 4 cm | 6 cm |
| Comparative Example 5 | — | nicotinic acid (0.5 g/L) | 3 cm | 7 cm |
| Comparative Example 6 | — | diethanolamine (0.5 g/L) | 5 cm | 5 cm |
| Comparative Example 7 | — | Glycine (0.5 g/L) | 4 cm | 6 cm |

TABLE 2

| | Added Compound (Concentration) | | Measurement Location (μm) | | | | | | | | |
|---|---|---|---|---|---|---|---|---|---|---|---|
| | Hexamethylene tetramine | Other added compounds | 1 | 2 | 3 | 4 | 5 | 6 | 7 | 8 | 9 |
| Base bath | hexamethylene tetramine (0.5 g/L) | — | 0.953 | 0.892 | 0.877 | 0.853 | 0.655 | 0.519 | 0.385 | 0.243 | 0.153 |
| Example 1 | hexamethylene tetramine (0.5 g/L) | nicotinic acid (0.5 g/L) | 0.900 | 0.921 | 0.899 | 0.881 | 0.769 | 0.585 | 0.430 | 0.284 | 0.151 |
| Example 2 | hexamethylene tetramine (0.5 g/L) | nicotinic acid (1 g/L) | 0.821 | 0.832 | 0.789 | 0.742 | 0.632 | 0.502 | 0.421 | 0.243 | 0.111 |
| Example 3 | hexamethylene tetramine (0.5 g/L) | nicotinic acid (3 g/L) | 0.787 | 0.801 | 0.792 | 0.732 | 0.601 | 0.473 | 0.376 | 0.201 | 0.098 |
| Example 4 | hexamethylene tetramine (0.5 g/L) | diethanolamine (1 g/L) | 0.934 | 0.967 | 0.875 | 0.840 | 0.674 | 0.593 | 0.385 | 0.287 | 0.151 |
| Example 5 | hexamethylene tetramine (0.5 g/L) | diethanolamine (3 g/L) | 0.901 | 0.921 | 0.881 | 0.851 | 0.709 | 0.619 | 0.395 | 0.235 | 0.132 |
| Example 6 | hexamethylene tetramine (0.5 g/L) | glycine (3 g/L) | 1.023 | 0.876 | 0.899 | 0.816 | 0.641 | 0.471 | 0.371 | 0.230 | 0.190 |
| Example 7 | hexamethylene tetramine (0.5 g/L) | thiolactic acid (10 g/L) | 0.970 | 0.914 | 0.875 | 0.839 | 0.621 | 0.564 | 0.367 | 0.300 | 0.171 |
| Example 8 | hexamethylene tetramine (0.5 g/L) | diethanolamine (3 g/L) + dihydrogen ammonium phosphate (4.5 g/L) | 0.953 | 0.989 | 1.024 | 0.817 | 0.709 | 0.619 | 0.395 | 0.295 | 0.155 |
| Example 9 | hexamethylene tetramine (0.5 g/L) | nicotinic acid (0.5 g/L) + glycine (1 g/L) | 0.932 | 0.989 | 0.872 | 0.856 | 0.721 | 0.621 | 0.478 | 0.281 | 0.161 |
| Example 10 | hexamethylene tetramine (0.5 g/L) | nicotinic acid (0.5 g/L) + glycine (3 g/L) | 0.996 | 0.934 | 0.922 | 0.891 | 0.723 | 0.639 | 0.451 | 0.281 | 0.159 |
| Example 11 | hexamethylene tetramine (0.5 g/L) | nicotinic acid (0.5 g/L) + glycine (5 g/L) | 1.047 | 0.943 | 0.98 | 0.828 | 0.73 | 0.646 | 0.438 | 0.276 | 0.164 |
| Comparative Example 1 | — | — | 1.032 | 0.906 | 0.923 | 0.932 | 0.802 | 0.839 | 0.744 | 0.467 | 0.339 |
| Comparative Example 2 | hexamethylene tetramine (0.5 g/L) | imidazole (0.5 g/L) | 0.987 | 0.966 | 0.996 | 1.002 | 0.922 | 0.821 | 0.621 | 0.523 | 0.267 |
| Comparative Example 3 | hexamethylene tetramine (0.5 g/L) | imidazole(1 g/L) | 0.932 | 0.978 | 1.019 | 1.023 | 0.901 | 0.834 | 0.689 | 0.501 | 0.277 |
| Comparative Example 4 | hexamethylene tetramine (0.5 g/L) | imidazole (5 g/L) | 0.942 | 0.922 | 1.001 | 1.023 | 0.975 | 0.890 | 0.671 | 0.461 | 0.256 |
| Comparative Example 5 | — | nicotinic acid (0.5 g/L) | 1.002 | 0.989 | 1.011 | 0.988 | 0.922 | 0.822 | 0.601 | 0.456 | 0.256 |
| Comparative Example 6 | — | diethanolamine (0.5 g/L) | 0.971 | 0.989 | 0.911 | 0.855 | 0.765 | 0.631 | 0.523 | 0.301 | 0.256 |
| Comparative Example 7 | — | Glycine (0.5 g/L) | 0.972 | 0.942 | 0.977 | 0.922 | 0.866 | 0.655 | 0.401 | 0.256 | 0.201 |

From the hull cell test results, as can be seen in Table 1, the plating solution of the present invention has a broad glossy range, and positively forms a favorable plating film even at a high current density. Furthermore, as shown in Table 2, it was confirmed that the plating deposition was poor in regions of low current density. Because plating deposition is poor in areas of low current density, deposition of the plating film will not occur in regions where deposition is not desired, and this means that the plating deposition selectivity is excellent.

Spot Plating Test

A copper plate on which nickel plating was deposited as a base film on the nickel plate was prepared as the object for plating. In order to confirm the deposition selectivity of the gold cobalt alloy a plating film, a mask made of silicon rubber was formed on the entire surface of the copper plate, and circles (diameter 10 mm) were cut in the center region of the mask to expose the nickel film. However, a gap was formed between the mask layer and the nickel plating layer along the edge of the round opening by inserting a 0.5 mm thick plate made of epoxy resin between the nickel plating layer and the mask layer in proximity to the round opening region (1.5 mm from the edge). Therefore when the object to be plated was immersed in the plating solution, plating solution was able to penetrate into the gap between the mask layer and the nickel plating layer. Because a mask layer exists above the region of the gap, the gap region has a lower current density during electrolysis than does the opening region.

The aforementioned objects for plating were immersed in plating solutions prepared according to the aforementioned Examples 7 through 10 and Comparative Example 1, and then gold alloy plating was performed while agitating with a pump at the current density shown in Table 3 at a bath temperature of 60° C., using platinum clad titanium as an insoluble positive electrode. The plating time was 2 seconds in each case. The appearance of the deposited plating was visually confirmed and the results are shown in Table 3. The gold cobalt alloy the plating film at this time was formed to a thickness between 0.3 and 0.5 μm in the round opening region of the object for plating. The amount of deposition in the region away from the opening region of the object for plating where there was no mask was measured as the deposition selectivity of the plating film. The thickness of the plating that was deposited in positions 0.5 mm in the epoxy resin plate direction from the edge of the round opening (region where gap is formed) was measured using a fluorescent light x-ray microfilm thickness meter (SFT-9400 manufactured by SII). The results are shown in Table 4. The units are shown in micrometers (μm).

TABLE 3

| | Appearance of Film Deposited in Round Region | | | |
|---|---|---|---|---|
| | 40 ASD | 50 ASD | 60 ASD | 70 ASD |
| Example 7 | Uniform glossy appearance | Uniform glossy appearance | Uniform glossy appearance | Uniform glossy appearance |
| Example 10 | Uniform glossy appearance | Uniform glossy appearance | Uniform glossy appearance | Uniform glossy appearance |
| Comparative Example 1 | Uniform glossy appearance | Uniform glossy appearance | Burn | Burn |

TABLE 4

| | Plating Thickness in Regions Away from Round Opening | | | |
|---|---|---|---|---|
| | 40 ASD | 50 ASD | 60 ASD | 70 ASD |
| Example 7 | 0.004 | 0.005 | 0.006 | 0.004 |
| Example 10 | 0.003 | 0.003 | 0.003 | 0.003 |
| Comparative Example 1 | 0.031 | 0.029 | 0.029 | 0.035 |

As shown by the aforementioned embodiments, when electrolytic plating is performed using the acidic gold alloy plating solution of the present invention, a glossy hard gold alloy plating film can be deposited in the desired location across a wide range of current density, and particularly in the high current density region, and deposition of the gold alloy plating film can be suppressed in undesired regions, and therefore a hard gold alloy plating film with increased deposition selectivity can be provided.

What is claimed is:

1. An acidic gold alloy plating solution containing gold cyanide or salt thereof, cobalt ions, chelating agent, between 0.05g/L and 10g/L of hexamethylene tetramine, and a glossing agent, wherein the glossing agent of said plating solution is a nitrogen atom containing compound with a carboxyl group or a hydroxyl group, or a sulfur atom containing compound with a carboxyl group.

2. The acidic gold alloy plating solution according to claim 1, wherein the glossing agent is at least one compound selected from a group consisting of alkanolamines, dialkanolamines, trialkanolamines, amino acids, pyridine carboxylic acid, and thiocarboxylic acid.

3. The acidic gold alloy plating solution according to claim 1, wherein the pH of the plating solution is in a range between 3 and 6.

4. The acidic gold alloy plating solution according to claim 1, wherein the chelating agent is a compound containing a carboxyl group.

5. The acidic gold alloy plating solution according to claim 1, wherein the hexamethylene tetramine is between 0.1 g/L and 5 g/L.

6. The acidic gold alloy plating solution according to claim 1, wherein the glossing agent ranges between 0.01 g/L to 50 g/L.

7. The acidic gold alloy plating solution according to claim 6, wherein the glossing agent ranges between 0.1 g/L to 10 g/L.

8. A method of forming a gold alloy plating film by electrolytic plating comprising, a) providing an acidic gold alloy plating solution containing gold cyanide or salt thereof, cobalt ions, chelating agent, between 0.05g/L and 10g/L of hexamethylene tetramine, and a nitrogen atom containing compound with a carboxyl group or a hydroxyl group, or a sulfur atom containing compound with a carboxyl group; and b) electrolytic plating the gold alloy plating film onto an electronic component at a current density of 10 $A/dm^2$ to 70 $A/dm^2$.

9. The method according to claim 8, wherein the pH of the plating solution is in a range between 3 and 6.

10. A method of manufacturing a connector formed with a gold alloy plating film, comprising:

performing nickel plating on the contact region of the connector; and performing gold alloy plating on the nickel plating; wherein said gold alloy plating is electrolytic plating at a current density of 10 $A/dm^2$ to 70 $A/dm^2$ and using an acidic gold alloy plating solution containing gold cyanide or salt thereof, cobalt ions, chelating agent, between 0.05g/L and 10g/L of hexamethylene tetramine, and a nitrogen atom containing compound with a carboxyl group or a hydroxyl group, or a sulfur atom containing compound with a carboxyl group.

11. The method of claim 10, wherein the current density is from 30 $A/dm^2$ to 50 $A/dm^2$.

* * * * *